US007873299B2

(12) United States Patent
Uto et al.

(10) Patent No.: US 7,873,299 B2
(45) Date of Patent: Jan. 18, 2011

(54) CONVEYED MATERIAL CONVEYING APPARATUS, IMAGE FORMING APPARATUS, CONVEYING METHOD, AND IMAGE FORMING METHOD

(75) Inventors: Osamu Uto, Kanagawa (JP); Toshikazu Takubo, Kanagawa (JP); Tetsuo Ishizuka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 554 days.

(21) Appl. No.: 11/785,170

(22) Filed: Apr. 16, 2007

(65) Prior Publication Data

US 2008/0080890 A1 Apr. 3, 2008

(30) Foreign Application Priority Data

Oct. 3, 2006 (JP) ..... P2006-271632

(51) Int. Cl.
*G03G 15/00* (2006.01)

(52) U.S. Cl. ..... 399/107

(58) Field of Classification Search ..... 399/107, 399/124, 381, 388, 391, 397, 401, 405
See application file for complete search history.

(56) References Cited

U.S. PATENT DOCUMENTS

| | | | | |
|---|---|---|---|---|
| 4,721,382 | A * | 1/1988 | Ito et al. | 399/23 |
| 6,882,823 | B2 | 4/2005 | Matsuyama et al. | 399/401 |
| 7,177,566 | B2 * | 2/2007 | Noda et al. | 399/107 |
| 7,559,642 | B2 * | 7/2009 | Shigemura | 347/104 |
| 2002/0127038 | A1 | 9/2002 | Omura | 399/401 |
| 2003/0129009 | A1 | 7/2003 | Matsuyama et al. | 399/401 |

FOREIGN PATENT DOCUMENTS

| | | |
|---|---|---|
| CN | 1475866 A | 2/2004 |
| JP | 10-026864 | 1/1998 |
| JP | 2002-265093 | 9/2002 |
| JP | 2004-69770 | 3/2004 |
| JP | 2005-308853 | 11/2005 |
| JP | 2006-258998 | 9/2006 |

* cited by examiner

*Primary Examiner*—Hoan Tran
(74) *Attorney, Agent, or Firm*—Morgan, Lewis & Bockius LLP

(57) ABSTRACT

A conveying apparatus includes a conveying unit that includes a conveying passage for conveying a conveyed material, and a positioning and holding unit that holds the conveying unit while positioning the conveying unit. The positioning and holding unit includes a plate-shaped member having at least one protruding portion, the plate-shaped member constitutes a part of the conveying passage, and the at least one protruding portion protrudes towards the conveying passage which the conveyed material passes through.

9 Claims, 4 Drawing Sheets

CONVEYED MATERIAL CONVEYING APPARATUS, IMAGE FORMING APPARATUS, CONVEYING METHOD, AND IMAGE FORMING METHOD

CROSS-REFERENCE TO RELATED APPLICATION

This application is based on and claims priority under 35 USC 119 from Japanese Patent Application No. 2006-271632 filed Oct. 3, 2006.

BACKGROUND

Technical Field

The present invention relates to a conveyed material conveying apparatus, an image forming apparatus, a conveying method, and an image forming method.

SUMMARY

According to an aspect of the invention, there is provided a conveying apparatus including: a conveying unit that comprises a conveying passage for conveying a conveyed material; a positioning and holding unit that holds the conveying unit while positioning the conveying unit, wherein the positioning and holding unit comprises a plate-shaped member having at least one protruding portion, the plate-shaped member constituting a part of the conveying passage, and the at least one protruding portion protruding towards the conveying passage which the conveyed material passes through.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the invention will be described by reference to the accompanying drawings.

First Exemplary Embodiment

FIGS. 1 to 3C are drawings which show a first exemplary embodiment of an image forming apparatus according to an aspect of the invention.

Figure 1:
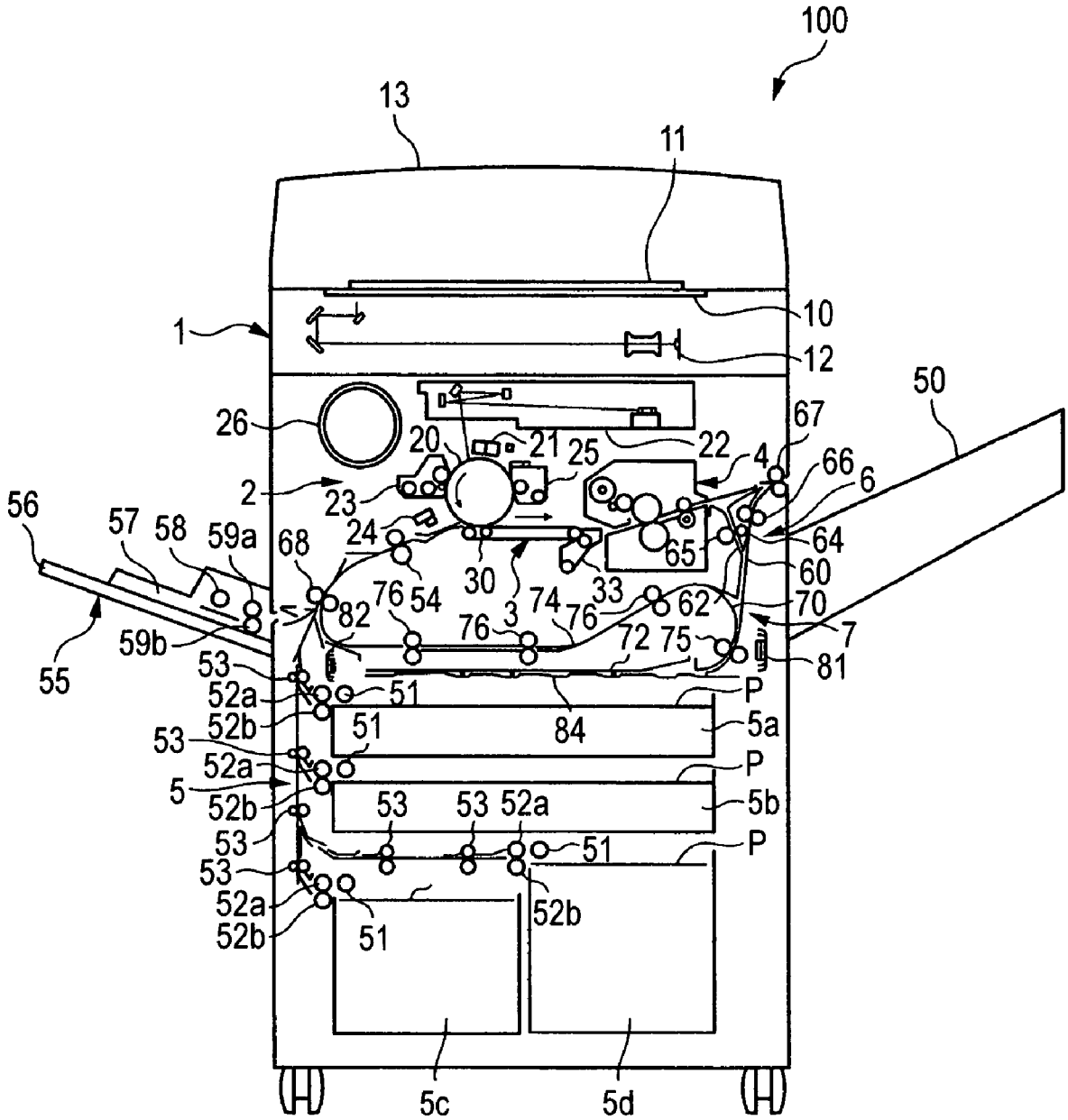
FIG. 1 illustrates a drawing showing an image forming apparatus of a first exemplary embodiment of the invention.

FIG. 1 is a diagram showing an image forming apparatus 100 in this embodiment. The image forming apparatus 100 has an image input unit 1 for optically reading image information of a document 11 placed on a platen 10 and converting the image information so read into electrical image data by a CCD sensor 12 and an image output unit 2 (an image forming unit) that forms an image on a sheet P (a recording medium) based on the image data transferred from the image input unit 1, and furthermore, the image forming apparatus 100 has an automatic document feeder 13 for automatically feeding a document 11 on to the platen 10.

The image output unit 2 forms a toner image on a light-sensitive material drum 20 based on the image data transferred from the image input unit 1, and thereafter transfers the toner image on to a sheet P, so as to form a recorded image on the sheet P. The sheet P on which the toner image is transferred is discharged on to a discharge tray 50 via a fixing unit 4.

In addition, the light-sensitive material drum 20 of the image output unit 2 rotates at a predetermined processing speed in a direction indicated by an arrowed line, and arranged on the periphery of the light-sensitive material drum 20 are a charging corotron 21 for uniformly charging a surface of the light-sensitive material drum 20 up to a predetermined background potential, a laser beam scanner 22 for exposing the light-sensitive material drum 20 with a laser beam which is modulated based on the image data so as to form an electrostatic latent image on the light-sensitive material drum 20, a developing unit 23 for developing the electrostatic latent image on the light-sensitive material drum 20, a pre-transfer processing corotron 24 for removing the potential on the light-sensitive material drum 20 prior to the transfer of the toner image on to the sheet P, and a cleaner 25 that removes residual toner on the light-sensitive material drum 20 after the completion of transfer of the toner image. Note that in the figure, reference numeral 26 denotes a toner cartridge which contains toner that is to be supplied to the developing unit 23. Note that the components that have been described above are constituent components of the image output unit 2.

On the other hand, a conveying belt 3 that conveys a sheet P is wound round a driving roller and a follower roller in such a manner as to be extended therebetween and rotates in a direction indicated by an arrowed line, and a toner image formed on the light-sensitive material drum 20 is designed to be transferred on to a sheet P which is conveyed thereto by the conveying belt 3. An image transfer roller 30 that forms a transfer electric field between the light-sensitive material drum 20 and itself is provided in a position which faces the light-sensitive material drum 20 across the conveying belt 3. In addition, a belt cleaner 33 is provided in a predetermined position along the conveying belt 3 for removing paper dust and/or residual toner from the surface of the conveying belt 3. Note that the components that have been described above are constituent components of the conveying belt 3.

In addition, a sheet feeding unit 5 that feeds a sheet P to the image output unit 2 is provided below the image output unit 2. Four sheet feeding trays 5*a* to 5*d* are equipped in the sheet feeding unit 5 which store sheets P in different sizes. In addition, in the sheet feeding unit 5, pick-up rollers 51 that convey topmost sheets stored in the individual sheet feeding trays 5*a* to 5*d* towards the image output unit 2 are provided in order to convey sheets P to the image output unit 2 a sheet at a time, and feed rollers 52*a* and retarder rollers 52*b* are provided downstream of the pick-up rollers 51 in the direction in which sheets P are conveyed as double-sheet protectors which prevent a plurality of sheets P from being fed in a superposed fashion to the image output unit 2 by the pick-up rollers 51. In addition, a plurality of conveying rollers 53 are provided in the sheet feeding unit 5 along a conveying path of sheets P extending from the individual sheet feeding trays 5*a* to 5*d* to a toner image transferring position. Additionally, registration rollers 54 are provided just before the image transferring position in the sheet feeding unit 5. The registration rollers 54 convey sheets P conveyed from the sheet feeding trays 5*a* to 5*d* to the image transferring position at a predetermined timing which is in synchronism with a writing timing at which an electrostatic latent image is written on to the light-sensitive material drum 20.

In addition, a sheet feeding device 55 is provided at one side end portion of the image forming apparatus 100 for feeding sheets P from an exterior portion of the image forming apparatus 100 into an interior of the image forming apparatus 100. The sheet feeding device 55 is made up of a tray 56 on which sheets P are placed and a feeding unit 57 that feeds sheets P placed on the tray 56 into the interior of the image forming apparatus 100 a sheet at a time. The sheet feeding unit 57 includes a pick-up roller 58 that conveys a topmost sheet of the sheets P placed on the tray 56 towards the interior of the image forming apparatus 100, as well as a feed roller 59*a* and a retarder roller 59*b* as a double-sheet protector which prevents a plurality of sheets P from being conveyed in a superposed fashion towards the interior of the image forming apparatus 100 by the pick-up roller 58, the feed roller 59*a* and the retarder roller 59*b* being provided downstream of the pick-up roller 58 in the direction in which sheets P are conveyed.

In addition, a reverse discharge unit 6 is disposed between the fixing unit 4 and the discharge tray 50 for reversing a sheet P discharged from the fixing unit 4 so as to be discharged on to the discharge tray 50. A reverse conveying passage 60 is formed in the reverse discharge unit 6. The reverse conveying passage 60 is made up of a primary reverse discharge passage 62 for drawing a sheet P discharged from the fixing unit 4 thereinto and a secondary reverse discharge passage 64 for reversing the conveying direction of the sheet P so drawn in to discharge the sheet P on to the discharge tray 50. Conveying rollers 65 are provided on the primary reverse discharge passage 62. Conveying rollers 66 are provided on the secondary reverse discharge passage 64. In addition, discharge rollers 67 are provided just before the discharge tray 50.

In addition, a reverse conveying unit 7 is disposed below the image output unit 2 and above the sheet feeding trays 5*a* to 5*d* in the sheet feeding unit 5 for reversing a sheet P on one side of which an image is formed by the image output unit 2 to convey the sheet P so reversed back to the image output unit 2 for an image to be formed on the other side thereof for double-side image formation. A reverse conveying passage 70 is formed in the reverse conveying unit 7. The reverse conveying passage 70 is made up of a primary reverse discharge passage 72 for drawing a sheet P discharged from the fixing unit 4 thereinto and a secondary reverse discharge passage 74 for reversing the conveying direction of the sheet P so drawn in to discharge the sheet P to the image output unit 2. Conveying rollers 75 are provided on the primary reverse discharge passage 72. In addition, discharge rollers 76 are provided on the secondary reverse conveying passage 74.

In addition, conveying rollers 68 are provided upstream of the registration rollers 54 in the sheet feeding unit 5 for conveying sheets P conveyed from the sheet feeding trays 5*a* to 5*d*, the sheet feeding device 55 and the reverse conveying unit 7 to the registration roller 54.

Note that the image output unit 2, the conveying belt 3, the fixing unit 4, part of the sheet feeding unit 5, the reverse discharge unit 6 and the reverse conveying unit 7 are supported on a support member 8 (a support unit). In addition, the conveying belt 3, the fixing unit 4, the part of the sheet feeding unit 5, the reverse discharge unit 6 and the reverse conveying unit 7 (a drawer unit U) are supported on sliding rails 81, 82 which are provided slidably relative to the support member 8 in such a manner as to be drawn out to the front of the apparatus.

In the image forming apparatus 100 of the exemplary embodiment which is configured as has been described heretofore, the laser beam scanner 22 exposes the light-sensitive material drum 20 based on image information on a document which is captured by the image input unit 1, and an electrostatic latent image matching the image information is written on to the light-sensitive material drum 20. This electrostatic latent image is developed by the developing unit 23 at a timing which is slightly later than the writing timing. Then, a toner image, which is formed in this way, is transferred on to a sheet P which is conveyed from the registration rollers 54 by the image transfer roller 30 at a predetermined timing, and the sheet P on which the unfixed toner image is transferred is discharged on to the discharge tray 50 via the fixing unit 4.

Note that the sheet P, whose unfixed image has been fixed by the fixing unit 4, is conveyed to the reverse discharge unit 6 so as to be reversed thereby for discharge on to the discharge tray 50.

In addition, the sheet P, whose unfixed toner image formed on one side thereof has been fixed by the fixing unit 4, is conveyed to the reverse conveying unit 7 so as to be reversed to be conveyed back to the image output unit 2 for an image to be formed on the other side thereof for double-side image formation and is then discharged on to the discharge tray 50.

Figure 2:
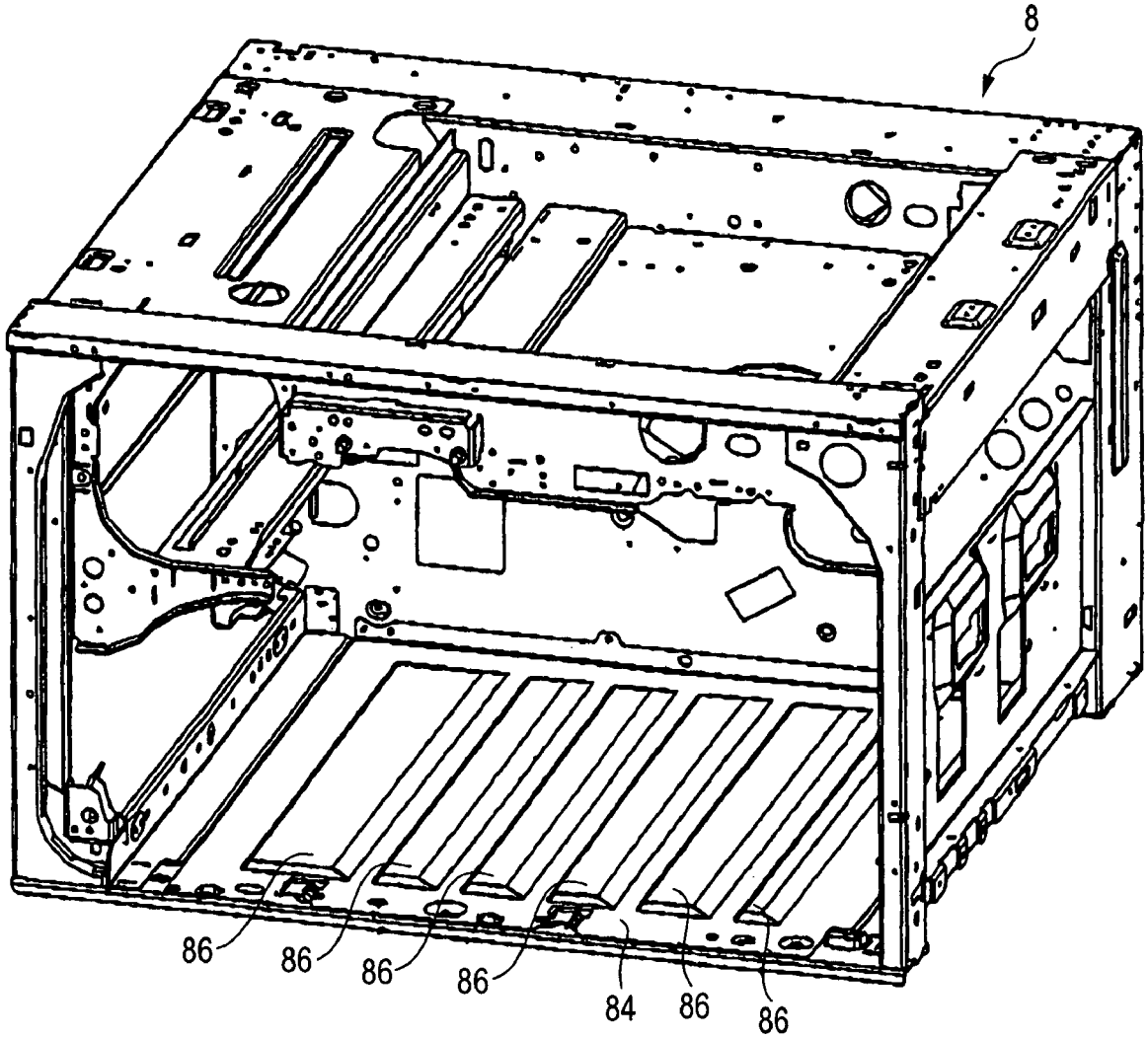
FIG. 2 illustrates a perspective view showing a support member of the image forming apparatus of the first exemplary embodiment.

FIG. 2 is a perspective view showing the support member 8 of the image forming apparatus 100 of the exemplary embodiment. The support member 8 is formed into a box-like shape which is opened at the front thereof and supports the image output unit 2, the conveying belt 3, the fixing unit 4, the part of the sheet feeding unit 5, the reverse discharge unit 6 and the reverse conveying unit 7. A bottom plate 84 is provided at a bottom portion of the support member 8. The bottom plate 84 of the support member 8 constitutes the primary reverse conveying passage 72 of the reverse conveying unit 7.

Figure 3A:
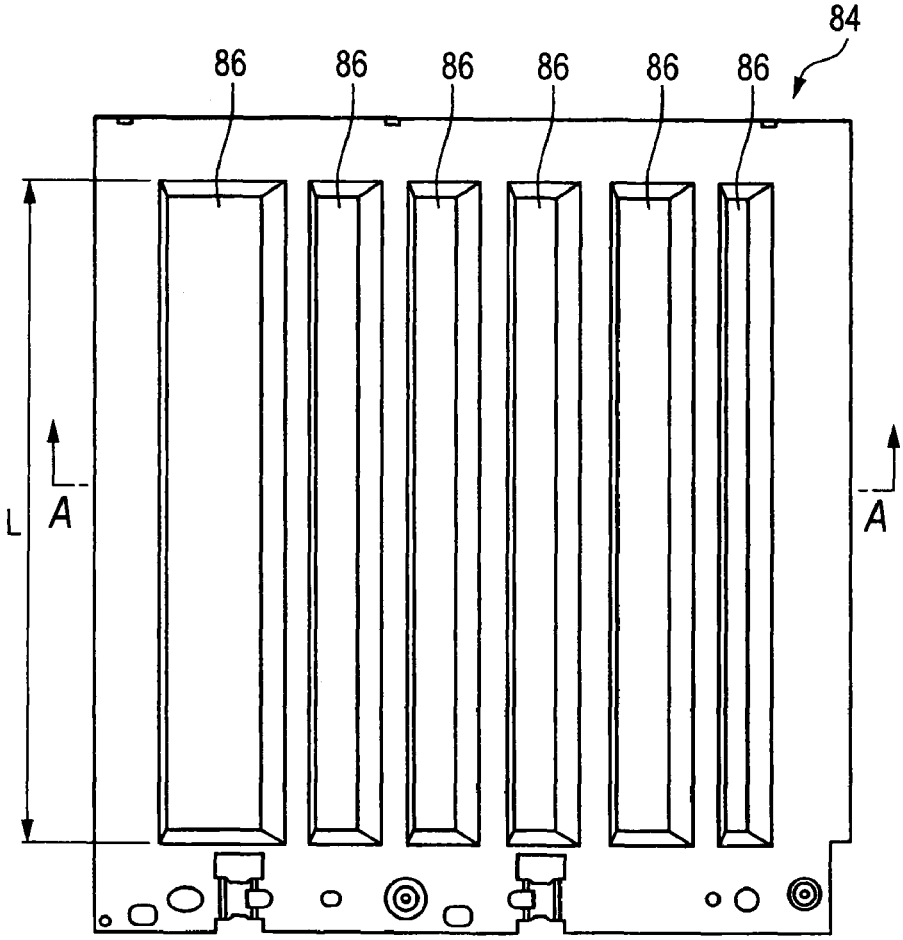
FIGS. 3A to 3C illustrate drawings showing a bottom plate of the support member of the image forming apparatus of the first exemplary embodiment.
Figure 3B:
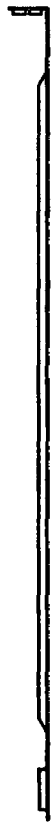
Figure 3C:
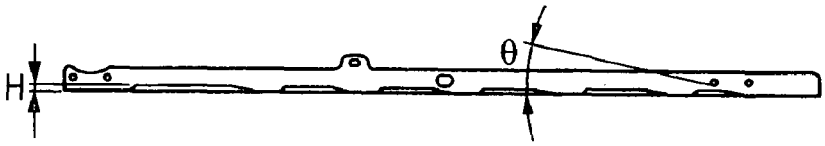

FIGS. 3A to 3C show drawings depicting the bottom plate 84 of the support member 8 of the image forming apparatus 100 of the exemplary embodiment. FIG. 3A is a plane view of the bottom plate 84. FIG. 3B is a side view of the bottom plate 84. FIG. 3C is a sectional view taken along the line A-A in FIG. 3A.

The bottom plate 84 is formed substantially into a rectangular shape. A plurality of (in this exemplary embodiment, six) protruding portions 86 are formed on the bottom plate 84. The height of the protruding portions 86 is, for example, 2 mm or more and 6 mm or less. The protruding portions 86 are formed in a central portion of the bottom plate 84 which excludes edge portions thereof. The protruding portions 86 are formed in such a manner as to extend in a direction which intersects the direction in which sheets P are conveyed substantially at right angles. The length L of the protruding portions 86 in a direction in which the protruding portions 86 extend is made longer than the width of a sheet P whose size is the largest in sheets used in the image forming apparatus 100, the width of the sheet P being defined as extending in a direction which intersects the direction in which sheets are conveyed substantially at right angles. In addition, the protruding portion 86 is formed in such a manner as to be inclined at a predetermined angle θ from a base portion to an apex portion thereof in a direction in which sheets P enter the primary reverse conveying passage 72. The predetermined angle θ is, for example, 10° or more and 20° or less. The protruding portions 86 are formed at predetermined intervals W according to lengths of a plurality of types of sheets P in the direction in which sheets P are conveyed. The plurality of types of sheets include, for example, sheets of a size of regular post cards, B5-size sheets, A4-size sheets, B4-size sheets and A3-size sheets. The predetermined interval W is an interval which enables a sheet P to stride across one or more intervals between the protruding portions 86 when the sheet P is drawn into the primary reverse conveying passage 72.

In addition, a member (not shown) is provided in such a manner as to be located to match positions between the protruding portions 86 for removing a sheet jam in association with an operation of drawing out the drawer unit in the event that a jam of a sheet or sheets P occurs in the primary reverse conveying passage 72.

Second Exemplary Embodiment

Next, a second exemplary embodiment of an image forming apparatus according to an aspect of the invention will be described.

Figure 4:
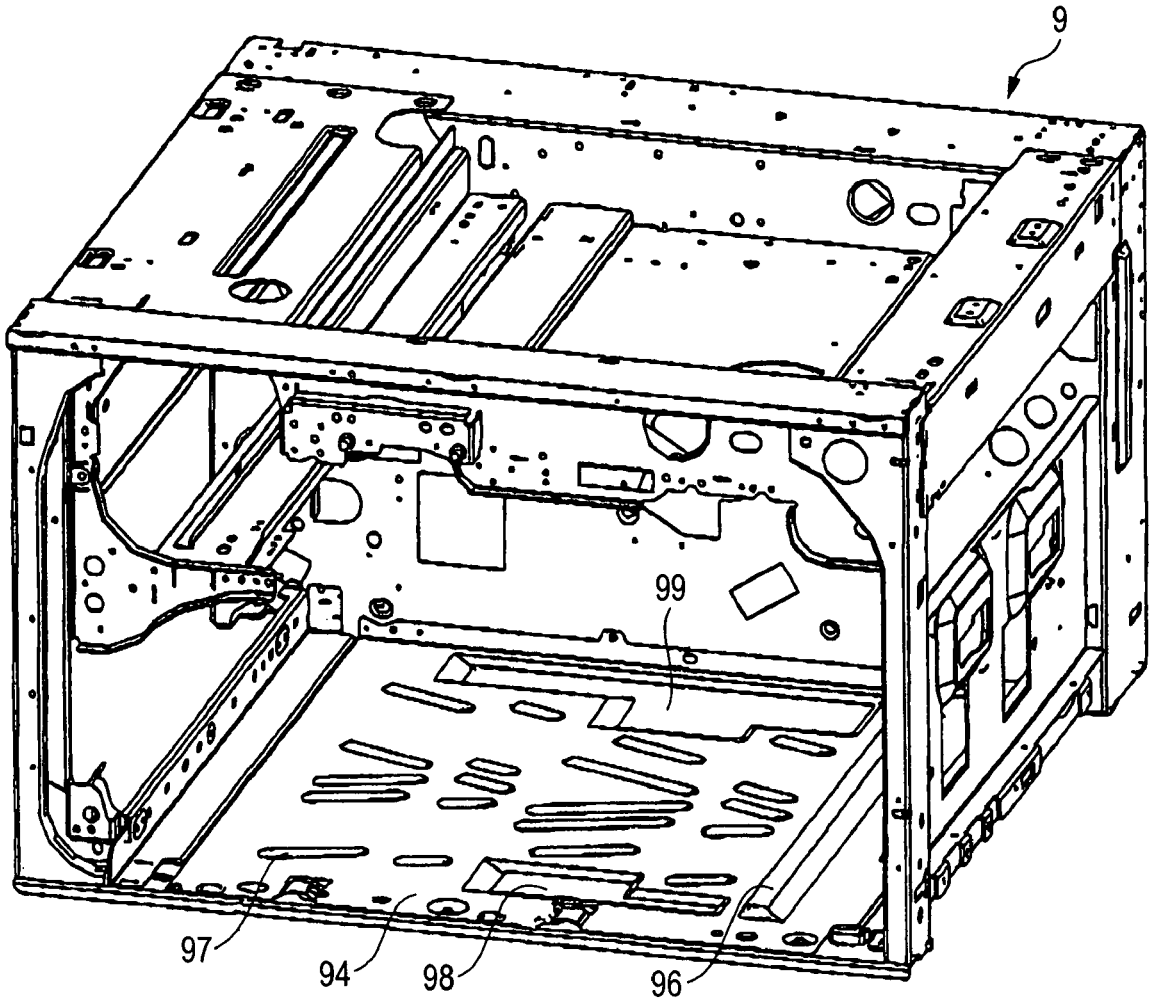
FIG. 4 illustrates a perspective view showing a support member of an image forming apparatus of a second exemplary embodiment.

FIG. 4 is a perspective view showing a support member 9 of an image forming apparatus of this exemplary embodiment. The image forming apparatus of this exemplary embodiment is such that the support member 8 of the image forming apparatus 100 of the first exemplary embodiment is replaced by the support member 9. The support member 9 in this exemplary embodiment is such that the bottom plate 84 of the support member 8 of the first exemplary embodiment is replaced by a bottom plate 94.

The bottom plate 94 is formed substantially into a rectangular. A protruding portion 96 is formed on an upstream side of the bottom plate 94 in a direction in which a sheet P enters a primary reverse conveying passage 72 in such a manner as to extend in a direction which intersects substantially at right angles a direction in which sheets P are conveyed. The length L of the protruding portion 96 in a direction in which the protruding portion 96 extend is made longer than the width of a sheet P whose size is the largest in sheets used in the image forming apparatus, the width of the sheet P being defined as extending in a direction which intersects the direction in which sheets are conveyed substantially at right angles. In addition, the protruding portion 96 is formed in such a manner as to be inclined at a predetermined angle θ from a base portion to an apex portion thereof in a direction in which sheets P enter the primary reverse conveying passage 72. In addition, a plurality of protruding portions 97 are formed on the bottom plate 94 in such a manner as to expand at predetermined angles and over predetermined lengths in a V-shaped fashion in the direction in which sheets P enter the primary reverse conveying passage 72. The protruding portions 97 are formed in such a manner as to become substantially symmetrical with each other at centers of V-shapes relative to a straight line which passes through a substantially central portion of a direction which intersects at right angles the direction in which sheets P are conveyed. In addition, distal end portions of the protruding portions 97 in the direction in which sheets P are conveyed are each formed into a circular arc shape. The protruding portion 96 and the protruding portions 97 are formed at predetermined intervals W according to lengths of a plurality of types of sheets P in the direction in which sheets P are conveyed. The plurality of types of sheets include, for example, sheets of a size of regular post cards, B5-size sheets, A4-size sheets, B4-size sheets and A3-size sheets. The predetermined interval W is an interval which enables a sheet P to stride across one or more intervals between the protruding portion 96 and the protruding portions 97 when the sheet P is drawn into the primary reverse conveying passage 72. In addition, the protruding portion 96 and the protruding portions 97 are formed at a central portion of the bottom plate 94 which excludes edge portions thereof. Recessed portions 98, 99 are formed at both edge portions of the bottom plate 94 in a direction which intersects at right angles the direction in which sheets P are conveyed.

In addition, a member (not shown) is provided in such a manner as to be located to match positions between the protruding portion 96 and the protruding portions 97 for removing a sheet jam in association with an operation of drawing out the drawer unit in the event that a jam of a sheet or sheets P occurs in the primary reverse conveying passage 72.

Note that the invention is not limited to the embodiments that have been described heretofore but can be modified variously without departing from the spirit and scope of the invention. For example, while the exemplary embodiments are described as the bottom plate of the support member being used as a bottom surface of the reverse conveying passage of the reverse conveying unit, a side plate and a top plate of the support member can be used as a side surface and a top surface of the reverse conveying passage, respectively, or the bottom plate of the support member may be used not as part of the reverse conveying unit but as part of a non-reverse conveying unit. In addition, the support member does not denote only a member which is related to the whole of the apparatus but includes so-called subframe, unit frame and the like which support some of the constituent components of the apparatus.

While in the exemplary embodiments, as a sheet-shaped conveyed material conveying apparatus to which the invention can be applied, the so-called digital copier is raised which installs thereon the image reading apparatus based on the xerography method, the invention can be applied to image forming apparatuses which utilize methods other than the xerography such as the ink-jet method, and the invention can also be applied to a printer without an image reading apparatus. In addition, the invention can also be applied to a sheet feeding apparatus and a post-processing apparatus which are provided as options to an image forming apparatus.

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A conveying apparatus comprising:

a conveying unit that comprises a conveying passage for conveying a conveyed material;

a positioning and holding unit that holds the conveying unit while positioning the conveying unit, wherein the positioning and holding unit comprises a plate-shaped member having at least one protruding portion, the plate-shaped member constituting a part of the conveying passage, and the at least one protruding portion protruding towards the conveying passage which the conveyed material passes through, wherein the at least one protruding portion extends in a direction which intersects substantially at right angles with a direction in which the conveyed material is conveyed.

2. The conveying apparatus according to claim 1, wherein the at least one protruding portion is inclined from a base portion to an apex portion of the at least one protruding portion in a direction in which the conveyed material enters a part of the conveying passage.

3. The conveying apparatus according to claim 1, wherein the plate-shaped member has a plurality of protruding portions, and the plurality of protruding portions are formed at predetermined intervals according to a length of the conveyed material in a direction in which the conveyed material is conveyed.

4. An image forming apparatus comprising:

an image transfer unit that transfers an image on to a recording medium;

a reconveying unit that comprises a reconveying passage for conveying the recording medium on to which an image is transferred by the image transfer unit back to the image transfer unit; and a positioning and holding unit that holds the image transfer unit and the reconveying unit while positioning the image transfer unit and the reconveying unit relative to each other, wherein the positioning and holding unit comprises a plate-shaped member having at least one protruding portion, the plate-shaped member constituting a part of the reconveying passage, and the at least one protruding portion protruding towards the reconveying passage which the recording medium passes through, wherein the at least one protruding portion extends in a direction which intersects substantially at right angles with a direction in which the recording medium is conveyed.

5. The image forming apparatus according to claim 4, wherein the reconveying unit is a reverse conveying unit that reverses the recording medium on one surface of which an image is formed by the image transfer unit so as to convey the recording medium so reversed back to the image transfer unit, wherein the reverse conveying unit comprises a reverse conveying passage, and the plate-shaped member constitutes a part of the reverse conveying passage.

6. The image forming apparatus according to claim 4, wherein the at least one protruding portion is inclined from a base portion to an apex portion of the at least one protruding portion in a direction in which the recording medium enters a part of the reconveying passage.

7. The image forming apparatus according to claim 4, wherein the plate-shaped member has a plurality of protruding portions, and the plurality of protruding portions are formed at predetermined intervals according to a length of the recording medium in a direction in which the recording medium is conveyed.

8. A conveying method comprising:

conveying a conveyed material through a conveying passage in a conveying unit; positioning and holding the conveying unit, wherein positioning and holding the conveying unit is performed using a plate-shaped member having at least one protruding portion, the plate-shaped member constituting a part of the conveying passage, and the at least one protruding portion protruding towards the conveying passage which the conveyed material passes through, wherein the at least one protruding portion extends in a direction which intersects substantially at right angles with a direction in which the recording medium is conveyed.

9. An image forming method comprising:

transferring an image on to a recording medium by an image transfer unit;

reconveying the recording medium on to which an image is transferred through a reconveying passage in a reconveying unit; and positioning and holding the image transfer unit and the reconveying unit relative to each other by a positioning and holding unit, the positioning and holding unit comprising a plate-shaped member having at least one protruding portion, the plate-shaped member constituting a part of the reconveying passage, and the at least one protruding portion protruding towards the reconveying passage which the recording medium passes through, wherein the at least one protruding portion extends in a direction which intersects substantially at right angles with a direction in which the recording medium is conveyed.

* * * * *